US009309732B2

(12) United States Patent
Boyd

(10) Patent No.: US 9,309,732 B2
(45) Date of Patent: Apr. 12, 2016

(54) PUMP FOR CONTROLLING THE FLOW OF WELL BORE RETURNS

(71) Applicant: WEATHERFORD TECHNOLOGY HOLDINGS, LLC, Houston, TX (US)

(72) Inventor: Michael Boyd, Nisku (CA)

(73) Assignee: Weatherford Technology Holdings, LLC, Houston, TX (US)

( * ) Notice: Subject to any disclaimer, the term of this patent is extended or adjusted under 35 U.S.C. 154(b) by 275 days.

(21) Appl. No.: 13/943,970

(22) Filed: Jul. 17, 2013

(65) Prior Publication Data

US 2014/0318768 A1 Oct. 30, 2014

Related U.S. Application Data

(63) Continuation-in-part of application No. 13/872,713, filed on Apr. 29, 2013.

(60) Provisional application No. 61/639,455, filed on Apr. 27, 2012.

(51) Int. Cl.
*E21B 21/08* (2006.01)
*E21B 21/06* (2006.01)

(52) U.S. Cl.
CPC ..... *E21B 21/08* (2013.01); *E21B 21/063* (2013.01)

(58) Field of Classification Search
CPC .. E21B 21/08; E21B 2021/006; E21B 21/106
See application file for complete search history.

(56) References Cited

U.S. PATENT DOCUMENTS

| | | | | |
|---|---|---|---|---|
| 5,353,637 | A * | 10/1994 | Plumb et al. | 73/152.17 |
| 6,413,065 | B1 | 7/2002 | Dass | |
| 7,604,057 | B1 * | 10/2009 | Eriksen et al. | 166/377 |
| 2002/0011338 | A1 * | 1/2002 | Maurer et al. | 166/372 |
| 2003/0098181 | A1 * | 5/2003 | Aronstam et al. | 175/65 |
| 2004/0007131 | A1 * | 1/2004 | Chitty et al. | 95/253 |
| 2004/0007392 | A1 * | 1/2004 | Judge et al. | 175/206 |
| 2008/0060846 | A1 * | 3/2008 | Belcher et al. | 175/25 |
| 2009/0236144 | A1 * | 9/2009 | Todd et al. | 175/5 |
| 2009/0288821 | A1 * | 11/2009 | Eriksen et al. | 166/250.01 |
| 2011/0061872 | A1 * | 3/2011 | Mix et al. | 166/363 |
| 2013/0206423 | A1 * | 8/2013 | Weinstock et al. | 166/358 |
| 2014/0318772 | A1 * | 10/2014 | Boyd | 166/267 |

OTHER PUBLICATIONS

Schlumberger Oilfield Glossary entry for "returns", accessed Jun. 15, 2015 via www.glossary.oilfield.slb.com.*

* cited by examiner

*Primary Examiner* — Blake Michener
(74) *Attorney, Agent, or Firm* — Smith IP Services, P.C.

(57) ABSTRACT

An apparatus and method to control and exert a predetermined force back on the wellbore thereby controlling the hydrostatic force on the formation surrounding the well-bore, the inflow of fluids from the surrounding formation and the drilling circulating medium. The apparatus comprises and the method utilizes a pump having at least one pair of intermeshing and opposite-handed helical screws disposed within a chamber for restricting the flow of well bore returns. The speed of the pump may be varied to selectively restrict the flow of well bore returns from the well bore.

7 Claims, 3 Drawing Sheets

PUMP FOR CONTROLLING THE FLOW OF WELL BORE RETURNS

CROSS REFERENCE TO RELATED APPLICATIONS

This application is a Continuation-In-Part of U.S. patent application Ser. No. 13/872,713 filed on Apr. 29, 2013 entitled "Method and Apparatus for Controlling The Flow of Wellbore Returns" which claimed priority from U.S. Provisional Patent Application 61/639,455 filed on Apr. 27, 2012 entitled "Method and Apparatus for Controlling The Flow of Wellbore Returns", the contents of which are incorporated herein by reference.

FIELD OF THE INVENTION

The present invention is directed to oil and gas drilling operations, and in particular to a pump for controlling the flow of well bore returns.

BACKGROUND

During drilling operations, drilling fluid, also referred to as drilling mud, is pumped at high pressure down the well bore. Mud pumps draw drilling fluid from mud tanks and pump the drilling fluid at high pressure down the drill string. The drilling fluid jets out of the drill bit and cleans the bottom of the hole. The drilling fluid moves back up the well bore in the space between the drill sting and the side of the well bore, known as the annulus, flushing cuttings and debris to the surface. The pressurized drilling fluid creates down-hole hydrostatic pressure which promotes the prevention of formation fluids from entering into the well bore during drilling operations and suspends cuttings in the well bore during interruptions to drilling.

The mixture of drilling fluid, formation fluids and debris travelling back up the well bore to the surface is referred to as the 'well bore returns' or 'drilling returns'. The well bore returns also frequently contain dissolved gas which moves from the formation surrounding the well bore being drilled into the drilling fluid in the annulus.

Upon arrival at the surface, a series of valves and pipes are utilized to controllably direct the well bore returns to a mud gas separator, or to a de-gasser. A separator typically comprises a cylindrical or spherical vessel and can be either horizontal or vertical. It is used to separate gas from the drilling fluid. In the separator, the drilling fluid containing gas is usually passed over a series of baffles designed to separate gas and mud. Liberated free gas is moved to a flare line while the mud is discharged to a shale shaker and to a mud tank.

A de-gasser is used when the gas content of the drilling fluid is relatively lower and it operates on much the same principles as the separator. A vacuum is applied to the drilling fluid as it is passed over baffles to increase surface area thereby promoting the liberation of dissolved gas.

During drilling operations, it is extremely important to maintain constant down-hole hydrostatic pressure to try and prevent formation fluids and gases from entering into the well bore as mentioned above. This can be challenging due to shifting well bore conditions and frequent interruptions to drilling operations, such as tripping pipe. To maintain down-hole hydrostatic pressure, conventional drilling operations typically utilize one or more chokes at the well head. The primary role of the choke is to regulate the flow of well bore returns from the well head. The choke comprises an orifice that can be selectively opened or closed to control the flow rate of the well bore returns. Controlling the flow of the well bore returns at the well head in turn regulates down-hole pressure. There are both fixed and adjustable chokes, the latter being more conducive to enabling the fluid flow and pressure parameters to be adjusted to suit process and production requirements. However, there are problems associated with restricting the cross-sectional area of a conventional choke orifice to passively regulate down-hole pressure. First, as the cross-sectional area of the choke decreases, the likelihood of the choke becoming clogged with cuttings and debris increases. Second, for a given volumetric flow rate, as the cross-sectional area of the choke decreases, the velocity of the well bore returns within the choke increases, which increases the scouring effects of solids in the well bore returns on the choke. Third, the chokes do not accurately measure well bore return volume.

What is needed is an apparatus and a method of controlling well bore returns to regulate down-hole hydrostatic pressure that mitigates the problems of existing choke devices.

SUMMARY OF THE INVENTION

In one aspect the invention provides A method of controlling the flow of well bore returns to regulate the down-hole hydrostatic pressure of a well bore, the method comprising the steps of:

(a) directing the well bore returns to a reversible multiphase, positive displacement pump; and (b) controlling the speed and direction of the pump to selectively restrict or reverse the flow of the well bore returns through the pump.

In one embodiment, the method further comprises the step of measuring the volume of well bore returns passing through the pump.

An apparatus for controlling the flow of well bore returns to regulate the down-hole hydrostatic pressure of a well bore, the apparatus comprising;

(c) an intake flow line for receiving the flow of the well bore returns diverted from a blow-out-preventer stack of a well head; and (d) a reversible, multiphase, positive displacement pump connected to the intake flow line and a vessel for receiving the well bore returns.

In one embodiment, the apparatus may comprise means for measuring the volume of well bore returns passing through the pump. The apparatus may further comprise a source tank for fluid pumped by the pump into the well bore.

BRIEF DESCRIPTION OF THE DRAWINGS

In the drawings, like elements are assigned like reference numerals. The drawings are not necessarily to scale, with the emphasis instead placed upon the principles of the present invention. Additionally, each of the embodiments depicted are but one of a number of possible arrangements utilizing the fundamental concepts of the present invention. The drawings are briefly described as follows.

DETAILED DESCRIPTION OF PREFERRED EMBODIMENTS

The invention relates to an apparatus and a method of controlling the flow of well bore returns to regulate the hydrostatic force in a well-bore. When describing the present invention, all terms not defined herein have their common art-recognized meanings. To the extent that the following description is of a specific embodiment or a particular use of the invention, it is intended to be illustrative only, and not limiting of the claimed invention. The following description is intended to cover all alternatives, modifications and equivalents that are included in the spirit and scope of the invention, as defined in the appended claims.

Figure 1:
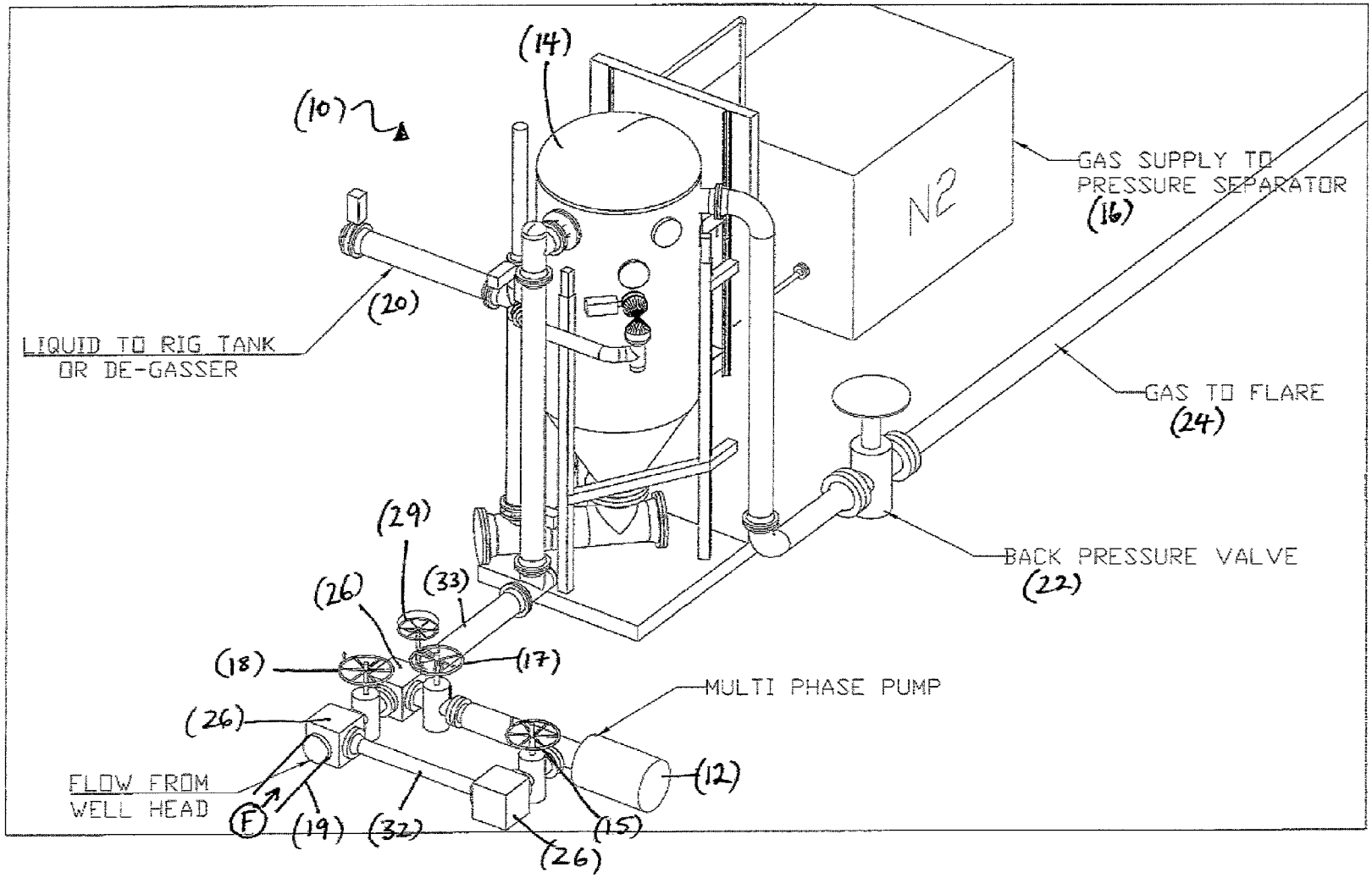
FIG. 1 is an elevated diagrammatic depiction of one embodiment of the present invention.

FIG. 1 depicts the apparatus (10) of the present invention. The apparatus (10) can be utilized to control and exert a predetermined force back on the wellbore thus controlling the hydrostatic force on the formation surrounding the well-bore, the inflow of fluids from the surrounding formation and the drilling circulating medium. In one embodiment, the apparatus (10) will also allow an operator to measure the volume of well-bore returns passing through the apparatus (10).

An intake flow line (19) receives the well bore return flow (F) that is diverted from the wellhead, blow-out-preventer ("BOP") stack, or rotating flow control diverter ("RFCD") (not shown in the Figures). As shown in FIG. 1, a diversion manifold (26) provides two alternate flow paths which can be interchangeably selected by selectively opening and closing gate valves (15, 17, 18). For example, if valve (18) is open and valve (15) is closed, then the flow will bypass pump (12).

The gate valves (18, 15, 17) may also all be closed to block the flow of well bore returns if required for safety purposes. As shown in FIG. 1, a choke valve (29) may be used with the present apparatus (10) and may be employed to quickly kill fluid flow if required. It should be understood that the choke valve (29) is present for safety purposes only and is not integral to the method of controlling the down-hole hydrostatic pressure described herein.

The first flow path passes through valve (18) and leads directly to the separator flow line (33) which is connected to a gas/liquid separator (14). Any suitable separator (14) may be used with the present invention provided that it has an adequate volume and pressure rating. In one embodiment, a gas source (16) is interconnected to the separator (14). The gas source may consist of any suitable equipment capable of producing on-site generated nitrogen, liquid nitrogen, natural gas, propane or $CO_2$. A liquid outlet line (20) leads from the separator (14) to a tank (38) or de-gasser (36) or to a shaker (34). A gas outlet line leads from the separator (14) to a flare stack (not shown in the Figures). The gas outlet line (24) has an integral back pressure valve (22).

The second flow path follows the pump flow line (32) to a multiphase, positive displacement pump (12). In one embodiment, the pump (12) comprises a twin screw helical pump comprising a body (40), two pairs of helical screws (50, 55), and a drive means (60). Helical screw pumps are well known in the art of multiphase pumps.

The body (40) defines an inlet (42), an outlet (44) and a chamber (46) in fluid communication with the inlet (42) and the outlet (44). The inlet (42) and outlet (44) are configured for receiving and releasing, respectively, well bore returns from an upstream point and a downstream point, respectively, of the flow path.

Each of the pairs of helical screws (50, 55) is disposed within the chamber (46), and consists of two intermeshing helical screws (50*a*, 50*b*; and 55*a*, 55*b*). The helical screws (50*a*, 50*b*; and 55*a*, 55*b*) within each pair (50, 55) are "opposite-handed" so that, when viewed from a common perspective, the threads of one of the helical screws (50*a*; and 55*a*) when axially rotated in one direction, and the threads of the other helical screw (50*b*; and 55*b*) when axially rotated in the opposite direction, both appear to advance either towards or away from the viewer. When the helical screws (50*a*, 50*b*; and 55*a*; 55*b*) are counter rotated, they displace the well bore returns from the inlet (42) to the outlet (44). As will be apparent to those persons skilled in the art, the pump (12) may be suited to a particular application by having as few as one pair of helical screws or as many pairs of helical screws, as is needed to achieve the desired down-hole hydrostatic pressure of the well bore, and the desired restriction of flow rate of the well bore returns.

The drive means (60) drivingly engages the helical screws (50*a*, 50*b*; and 55*a*, 55*b*) of each pair of helical screws (50, 55) so as to rotate them in opposite axial directions. In one embodiment, the drive means (60) comprises a drive motor (62) for providing a torque which is transmitted to the helical screws (50*a*, 50*b*; and 55*a*, 55*b*) via a primary drive shaft (64), engaging a gear set (66), engaging a pair of secondary shafts (68*a*, 68*b*) which support the helical screws (50*a*, 50*b*; and 55*a*, 55*b*). A bearing and seal assembly (48) isolates the drive motor (62), the drive shaft (54) and the gear set (66) from the chamber (46) and the well bore returns contained therein. The drive motor (62) may be powered by any suitable energy source such as electricity, diesel, gasoline or natural gas. The helical screws (50*a*, 50*b*; 55*a*, 55*b*) and the chamber (46) are dimensioned, and the parameters of the drive means (60) are selected such that the helical screws (50*a*, 50*b*; 55*a*, 55*b*) restrict the flow rate of well bore returns through the pump (12) over a desired range of operating speeds.

The function of the pump (12) is to selectively restrict the flow of well bore returns in the flow path, but the direction of the pumping effect is not essential. It is therefore conceivable that the pump direction may be reversed such that the pump pumps fluid back towards and into the well bore. Accordingly, the terms "inlet" and "outlet" prescribe neither a specific relationship to upstream and downstream points of the flow path, nor the direction in which the helical screws (50*a*, 50*b*; and 55*a*, 55*b*) displace the well bore returns.

Operation of the apparatus (10) depicted in FIG. 1 will now be described.

If an operator elects to flow the well bore returns through the pump (12) from the BOP stack, then the gate valve (18) mounted on the separator flow line (33) will be closed and the gate valves (15 and 17) on either side of the pump (12) will be opened. The flow is accordingly directed through the pump flow line (32) into an inlet of the pump (12). As a positive displacement pump, there will be no substantial flow through the pump until the pump is actuated. The flow of the well bore returns through the pump (12) can be restricted in a controlled manner by controlling the speed that the pump (12) runs at. The faster the pump runs, the less restriction the flow experiences. Conversely, the slower the pump runs, the more restricted the flow becomes. Inhibition of the flow of the well bore returns results in back pressure on the wellbore and an increase in down-hole hydrostatic pressure. In this manner the down-hole hydrostatic pressure can be controlled and maintained at a constant level by the varying the speed of the pump (12). Further to this, if the drilling program requires a constant pressure on the wellbore and this cannot be achieved by simply slowing or stopping the pump (12), then the pump (12) can be reversed to pump liquid from the separator or a designated storage tank back down the wellbore to maintain a constant pressure.

Use of a pump (12) also provides the operator with the means to accurately calculate the return volume of the well-bore returns. Such information is extremely important to the operator as they are continuously trying to achieve a net balance of liquid injection and liquid returns during operations. As the pump (12) is a positive displacement pump, it is possible to calculate the return volume of the pump during a particular time period, by multiplying a known volume of wellbore returns passing through the pump (12) in one revolution of the helical screws, the speed of the pump (e.g. in revolutions per minute), and the time period. The flow exits the pump (12) though an outlet and is directed to the separator flow intake line (33) (as shown in FIG. 1).

Figure 2:
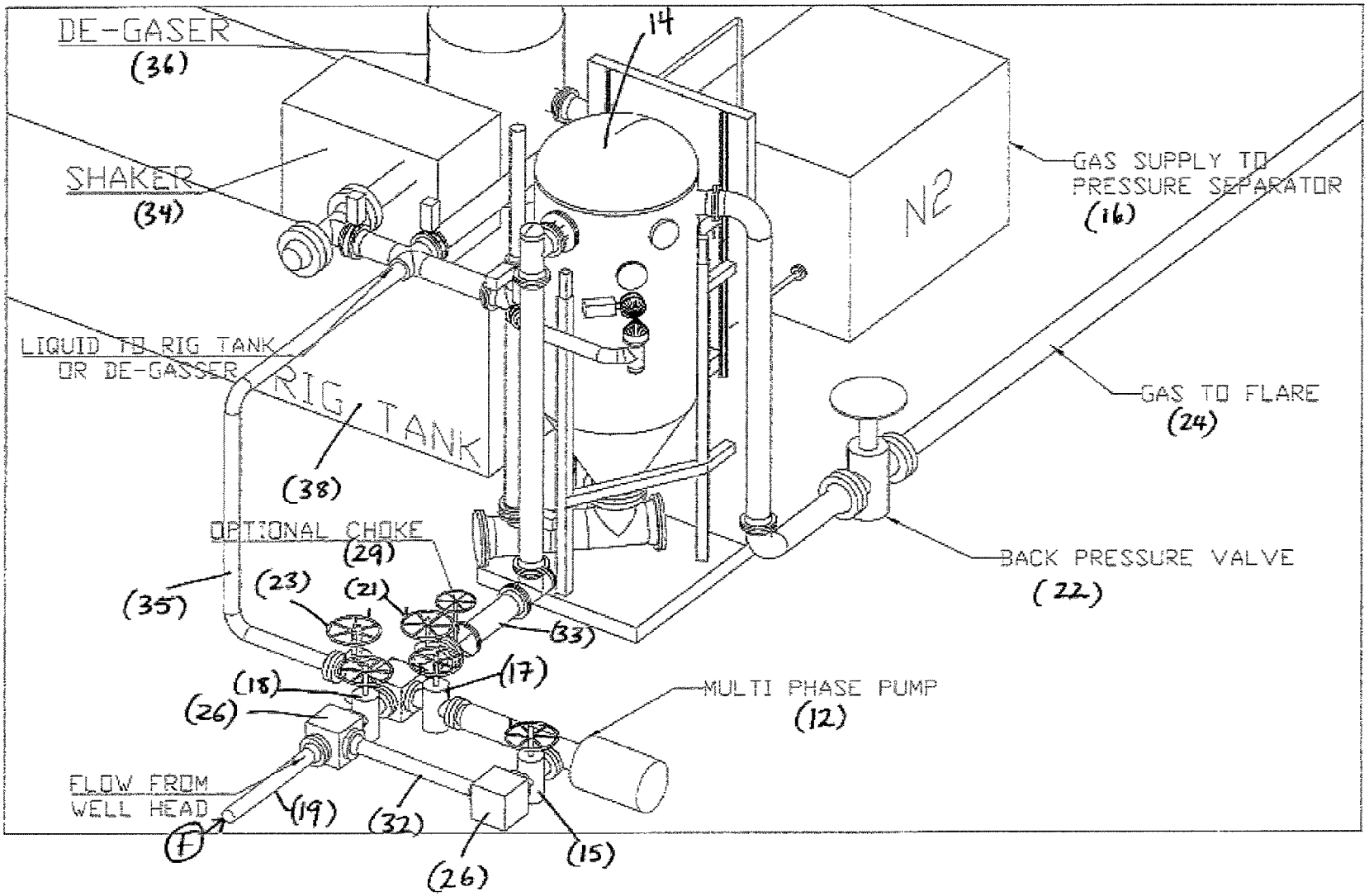
FIG. 2 is an elevated diagrammatic depiction of one embodiment of the present invention.
Figure 3:
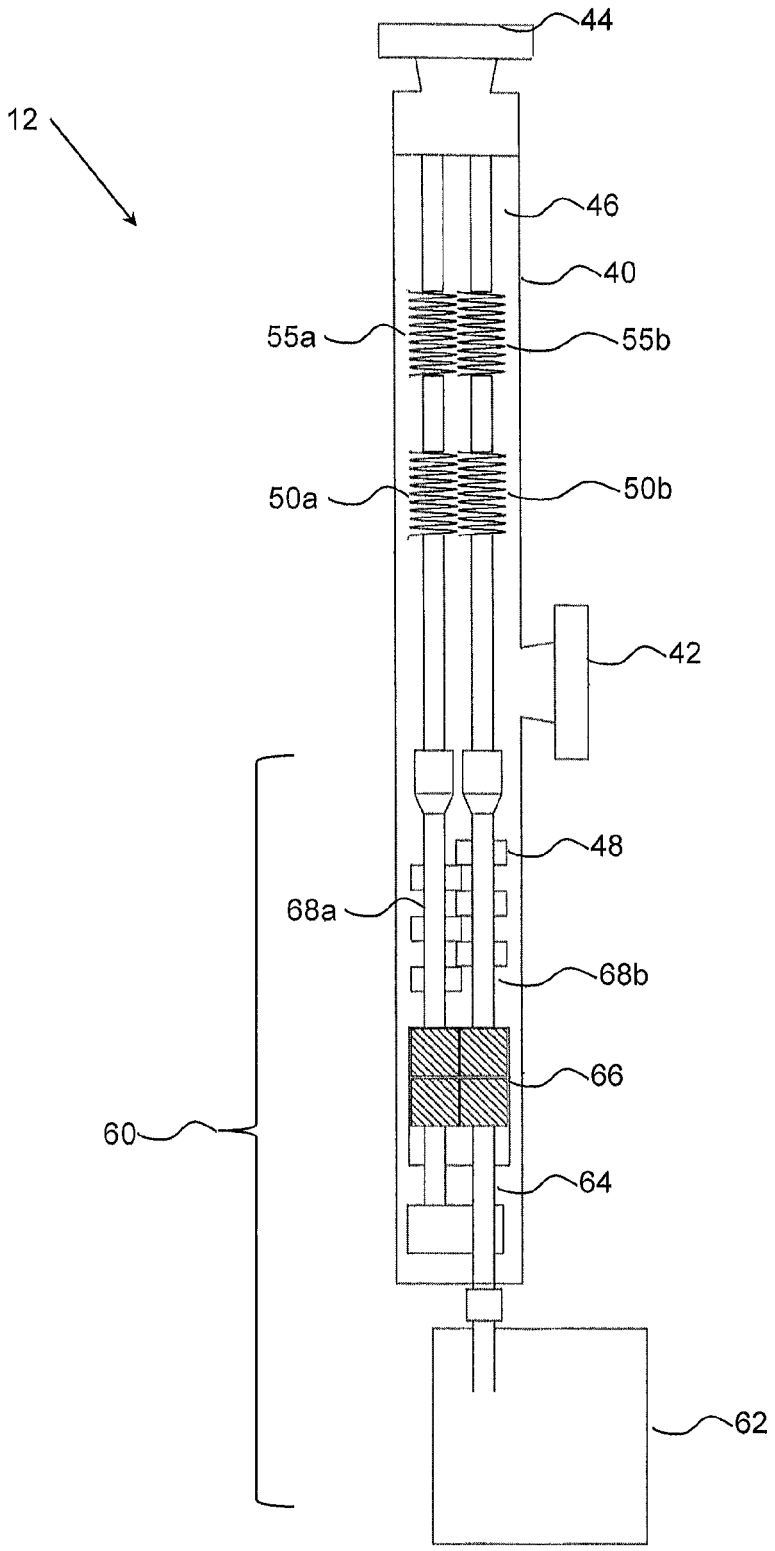
FIG. 3 is a sectional diagrammatic depiction of one embodiment of the pump utilized in the present invention.

While FIGS. 1 and 2 depict an embodiment of the apparatus having both a pump and a separator, one skilled in the art will realize that the present invention can be practiced using just a pump connected to a de-gasser and a shaker or using a separator without a pump.

If an operator elects to flow the well bore returns directly into the separator (14) from the BOP stack, the gate valves (15, 17) on either side of the pump (12) are closed and the gate valve (18) mounted on the separator flow line (33) is opened thereby directing flow directly along the separator flow line (33) into the separator (14). Gas is released from the well bore returns in the separator (14). If desired, in one embodiment, the back pressure valve (22) can be used to restrict the flow of gas out of the separator (14) into the gas outlet line (24). This results in a pressure build up in the separator (14) which inhibits the flow of the well bore returns into the separator (14) from the separator flow line (33). The restricted flow of well bore returns results in back pressure on the wellbore and an increase in down-hole hydrostatic pressure. In this manner the down-hole hydrostatic pressure can be controlled and maintained at a constant level by the back pressure valve (22) on the gas outlet line (24).

In the event that the returns do not have sufficient associated gasses to create the required back pressure in the separator (14) to restrict the flow of the well bore returns into the separator (14), then the internal pressure of the separator (14) can be artificially increased as required by the introducing gas into the separator (14) from the gas supply (16).

In the embodiment depicted in FIG. 2, an additional flow line (35) and additional gate valves (23, 21) may be utilized which allows the operator to direct the well bore returns directly to a de-gasser (36), a shaker (34) or to a rig tank (38) without having to pass through the separator. Using the apparatus (10) shown in FIG. 2, an operator could selectively run the well bore returns through the pump (12) and then directly to the de-gasser (36) and the shaker (34) by closing the gate valve mounted on the separator flow line (21) and by opening the gate valve (23) on flow line (35).

It should also be understood that while the pump (12) and the separator (14) may be used independently to control the flow of the well bore returns, they may also be used cooperatively to control the flow of well bore returns.

As will be apparent to those skilled in the art, various modifications, adaptations and variations of the foregoing specific disclosure can be made without departing from the scope of the invention claimed herein.

What is claimed is:

1. A method of controlling a flow of well bore returns to regulate a down-hole pressure of a well bore, the method comprising:

directing the well bore returns to a reversible multiphase, positive displacement pump positioned on a drilling rig; and controlling a speed and a direction of the pump to selectively restrict or reverse the flow of the well bore returns through the pump.

2. The method of claim 1, further comprising determining a volume of well bore returns passing through the pump.

3. The method of claim 1, wherein the pump comprises at least one pair of intermeshed helical screws disposed within a chamber.

4. An apparatus for controlling a flow of well bore returns to regulate a down-hole pressure of a well bore, the apparatus comprising:

a first flow line for receiving the flow of the well bore returns from a blow-out-preventer stack of a well head;

a reversible, multiphase, positive displacement pump positioned on a drilling rig and connected to the first flow line;

a vessel for receiving the well bore returns; and a second flow line which connects the pump to the receiving vessel.

5. The apparatus of claim 4, wherein a volume of the well bore returns passing through the pump is determined as a function of pump speed.

6. The apparatus of claim 4, wherein the receiving vessel supplies fluid to the pump during reverse operation of the pump.

7. The apparatus of claim 4, wherein the pump comprises at least one pair of intermeshed helical screws disposed within a chamber.

* * * * *